US009488077B2

(12) United States Patent
Suzuki et al.

(10) Patent No.: US 9,488,077 B2
(45) Date of Patent: Nov. 8, 2016

(54) VALVE TIMING CONTROL APPARATUS

(71) Applicant: DENSO CORPORATION, Kariya, Aichi-pref. (JP)

(72) Inventors: Tomonori Suzuki, Chiryu (JP); Masashi Hayashi, Okazaki (JP); Isao Hattori, Gifu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/791,581

(22) Filed: Jul. 6, 2015

(65) Prior Publication Data

US 2016/0010516 A1 Jan. 14, 2016

(30) Foreign Application Priority Data

Jul. 9, 2014 (JP) ..... 2014-141322

(51) Int. Cl.

| | |
|---|---|
| ***F01L 1/34*** | (2006.01) |
| ***F01L 1/344*** | (2006.01) |
| ***F01L 1/047*** | (2006.01) |
| ***F03C 2/30*** | (2006.01) |
| ***F04C 15/06*** | (2006.01) |

(52) U.S. Cl.

CPC ..... *F01L 1/3442* (2013.01); *F01L 1/047* (2013.01); *F03C 2/30* (2013.01); *F04C 15/066* (2013.01); *F01L 2001/3443* (2013.01); *F01L 2001/3444* (2013.01); *F01L 2001/34433* (2013.01); *F01L 2001/34469* (2013.01); *F01L 2001/34479* (2013.01); *F01L 2250/02* (2013.01)

(58) Field of Classification Search

CPC ..... F01L 1/047; F01L 1/3442; F03C 2/30; F04C 15/066

USPC ..... 123/90.15, 90.17; 464/160

See application file for complete search history.

(56) References Cited

U.S. PATENT DOCUMENTS

| | | | | |
|---|---|---|---|---|
| 8,904,980 | B2 * | 12/2014 | Hayashi | F01L 1/3442 123/90.17 |
| 2008/0173267 | A1 | 7/2008 | Takahashi et al. | |
| 2014/0090612 | A1 | 4/2014 | Hayashi et al. | |
| 2014/0373796 | A1 | 12/2014 | Hayashi et al. | |
| 2015/0034032 | A1 | 2/2015 | Ikuma et al. | |

FOREIGN PATENT DOCUMENTS

| | | |
|---|---|---|
| JP | H9-280019 | 10/1997 |
| JP | 2005-351182 | 12/2005 |

* cited by examiner

*Primary Examiner* — Ching Chang
(74) *Attorney, Agent, or Firm* — Nixon & Vanderhye PC

(57) ABSTRACT

A valve timing control apparatus includes a check valve, a filter, and a filter holding body. The check valve is placed between a camshaft and a vane rotor. The filter is placed between the camshaft and the check valve. The filter holding body includes a plurality of metal plates, which are stacked one after another. Two metal plates, which serve as enlarged space forming plates, are placed adjacent to the filter on one side of the filter where the camshaft is placed while each of the two metal plates includes enlarged through holes. A metal plate, which serves as an enlarged space forming plate, is placed adjacent to the filter on another side of the filter and includes enlarged through holes. A flow passage cross-sectional area of each enlarged through hole is larger than a flow passage cross-sectional area of a supply oil passage.

5 Claims, 11 Drawing Sheets

VALVE TIMING CONTROL APPARATUS

CROSS REFERENCE TO RELATED APPLICATION

This application is based on and incorporates herein by reference Japanese Patent Application No. 2014-141322 filed on Jul. 9, 2014.

TECHNICAL FIELD

The present disclosure relates to a valve timing control apparatus.

BACKGROUND

In a valve timing control apparatus of a hydraulic type, hydraulic oil is supplied into corresponding hydraulic chambers formed in a housing to rotate a vane rotor relative to the housing to adjust valve timing of intake valves and/or valve timing of exhaust valves of an internal combustion engine. In a case of a valve timing control apparatus disclosed in JPH09-280019A, hydraulic oil is supplied to the corresponding hydraulic chambers through an oil passage change valve that is placed in a center portion of a vane rotor. Furthermore, in the valve timing control apparatus disclosed in JPH09-280019A, a relatively large space is formed in a middle of a supply oil passage of a camshaft or a vane rotor to extend in an axial direction, and a mesh filter, which is configured into a cylindrical tubular form, is detachably installed in this space.

Inventors of the present application have an opinion of that in a case where a check valve is placed in the supply oil passage to limit a reduction in a response speed in a rotational phase control operation, the filter needs to be placed on an upstream side of the check valve in the supply oil passage in order to avoid malfunction of the check valve. This filter is a filter that can capture minute foreign objects that cannot be captured with a cartridge filter installed in the internal combustion engine. In this case, the placement of the filter in the location disclosed in JPH09-280019A is effective.

However, in the valve timing control apparatus of JPH09-280019A, the relatively large space, which extends in the axial direction, needs to be formed in the camshaft or the vane rotor to place the mesh filter, which is configured into the cylindrical tubular form, into the relatively large space. Thereby, an axial size of the valve timing control apparatus is disadvantageously increased, so that an installation space, which receives the valve timing control apparatus in the internal combustion engine, is disadvantageously increased in the axial direction.

SUMMARY

The present disclosure is made in view of the above point. According to the present disclosure, there is provided a valve timing control apparatus that is placed in a drive force transmission path, which transmits a drive force from a drive shaft of an internal combustion engine to a driven shaft, to adjust valve timing of a valve that is opened and closed by the driven shaft. One of the drive shaft and the driven shaft serves as a first shaft while another one of the drive shaft and the driven shaft serves as a second shaft. An oil passage, which opens in an end surface of the second shaft, serves as an external oil passage. The valve timing control apparatus includes a housing, a vane rotor, an oil passage change valve, a check valve, a filter, and a filter holding body. The housing is rotatable together with the first shaft. The vane rotor is placed along an extension of an axis of the second shaft and is rotatable together with the second shaft. The vane rotor forms a vane, which partitions an inside space of the housing into an advancing chamber and a retarding chamber. The vane rotor includes an advancing oil passage, a retarding oil passage, and a supply oil passage. The advancing oil passage is communicated with the advancing chamber. The retarding oil passage is communicated with the retarding chamber. The supply oil passage opens on a side where the second shaft is placed. The supply oil passage is communicatable with the external oil passage. The oil passage change valve is placed in a center portion of the vane rotor and includes an advancing port, a retarding port and a supply port. The advancing port is communicated with the advancing oil passage. The retarding port is communicated with the retarding oil passage. The supply port is communicated with the supply oil passage. The oil passage change valve connects between the supply port and the advancing port at a time of rotating the vane rotor toward an advancing side relative to the housing and connects between the supply port and the retarding port at a time of rotating the vane rotor toward a retarding side relative to the housing. The check valve is provided between the second shaft and the vane rotor or is provided in an inside of the vane rotor. The check valve enables flow of hydraulic oil from the external oil passage to the supply oil passage and blocks flow of the hydraulic oil from the supply oil passage to the external oil passage. The filter is placed between the second shaft and the check valve and filters a foreign object contained in the hydraulic oil that flows from the external oil passage to the supply oil passage. The filter holding body is a laminated body, which is placed between the second shaft and the vane rotor and includes a plurality of metal plates that are stacked one after another in an axial direction of the vane rotor while the filter is clamped between corresponding two of the plurality of metal plates. The filter holding body includes a connection oil passage that connects between the external oil passage and the supply oil passage. The plurality of metal plates includes a first-side enlarged space forming plate and a second-side enlarged space forming plate. The first-side enlarged space forming plate is placed adjacent to the filter on one side of the filter where the second shaft is placed. The first-side enlarged space forming plate includes a first-side enlarged through hole, which forms a part of the connection oil passage, and a flow passage cross-sectional area of the first-side enlarged through hole is larger than a flow passage cross-sectional area of the supply oil passage. The second-side enlarged space forming plate is placed adjacent to the filter on another side of the filter where the vane rotor is placed. The second-side enlarged space forming plate includes a second-side enlarged through hole, which forms a part of the connection oil passage, and a flow passage cross-sectional area of the second-side enlarged through hole is larger than the flow passage cross-sectional area of the supply oil passage.

BRIEF DESCRIPTION OF THE DRAWINGS

The drawings described herein are for illustration purposes only and are not intended to limit the scope of the present disclosure in any way.

DETAILED DESCRIPTION

Figure 1:
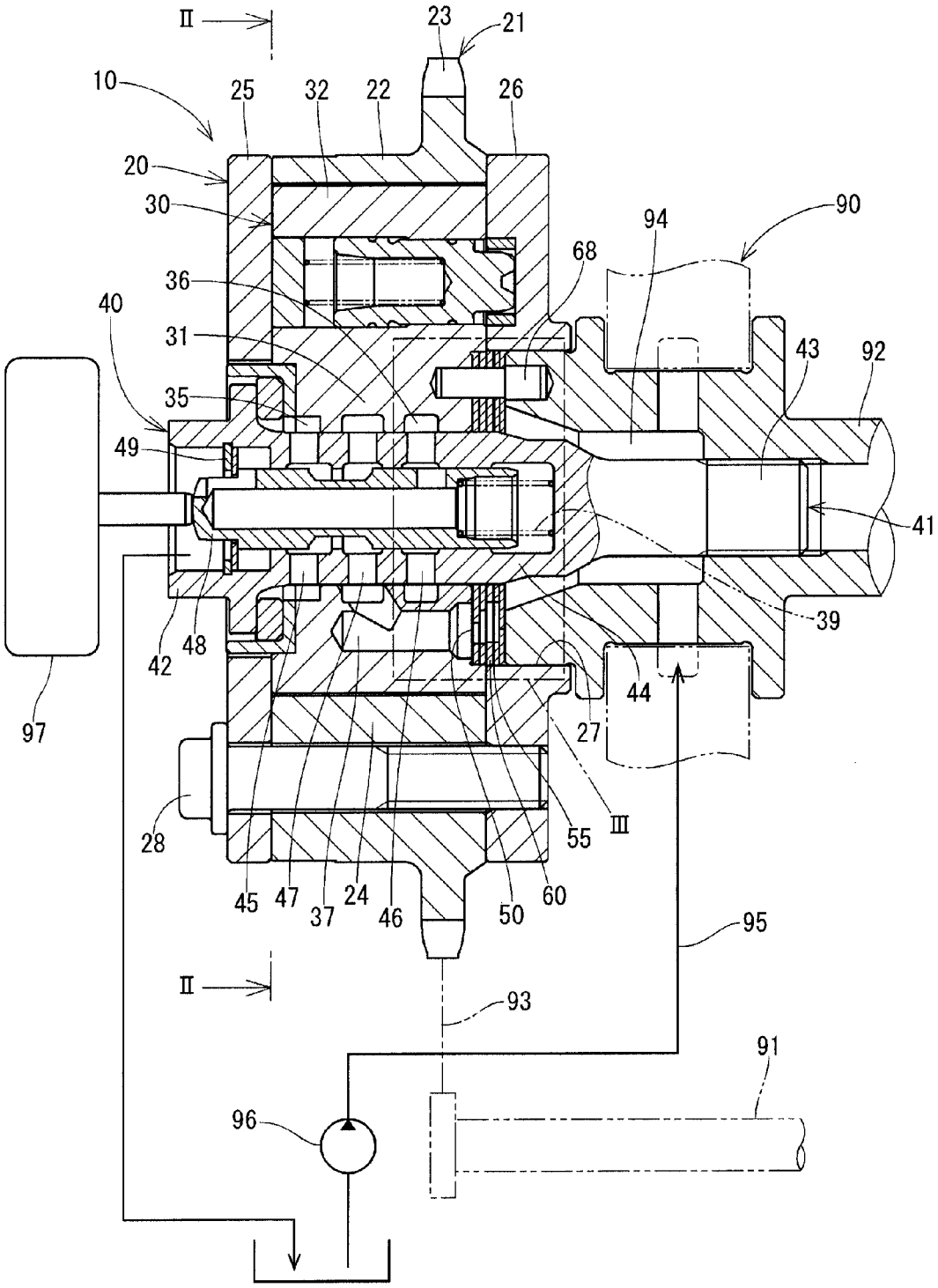
FIG. 1 is a cross-sectional view showing a schematic structure of a valve timing control apparatus according to a first embodiment of the present disclosure.

Various embodiments of the present disclosure will be described with reference to the accompanying drawings. In the following discussion of the embodiments, similar components will be indicated by the same reference numerals and will not be described redundantly for the sake of simplicity.

First Embodiment

FIG. 1 shows a valve timing control apparatus according to a first embodiment of the present disclosure. The valve timing control apparatus 10 adjusts valve timing of respective intake valves (not shown), which are opened and closed with a camshaft 92, by rotating the camshaft 92 relative to a crankshaft 91 of an internal combustion engine 90. The valve timing control apparatus 10 is placed in a drive force transmission path that transmits a drive force from the crankshaft 91 to the camshaft 92. The crankshaft 91 serves as a drive shaft of the present disclosure, and the camshaft 92 serves as a driven shaft of the present disclosure.

Figure 2:
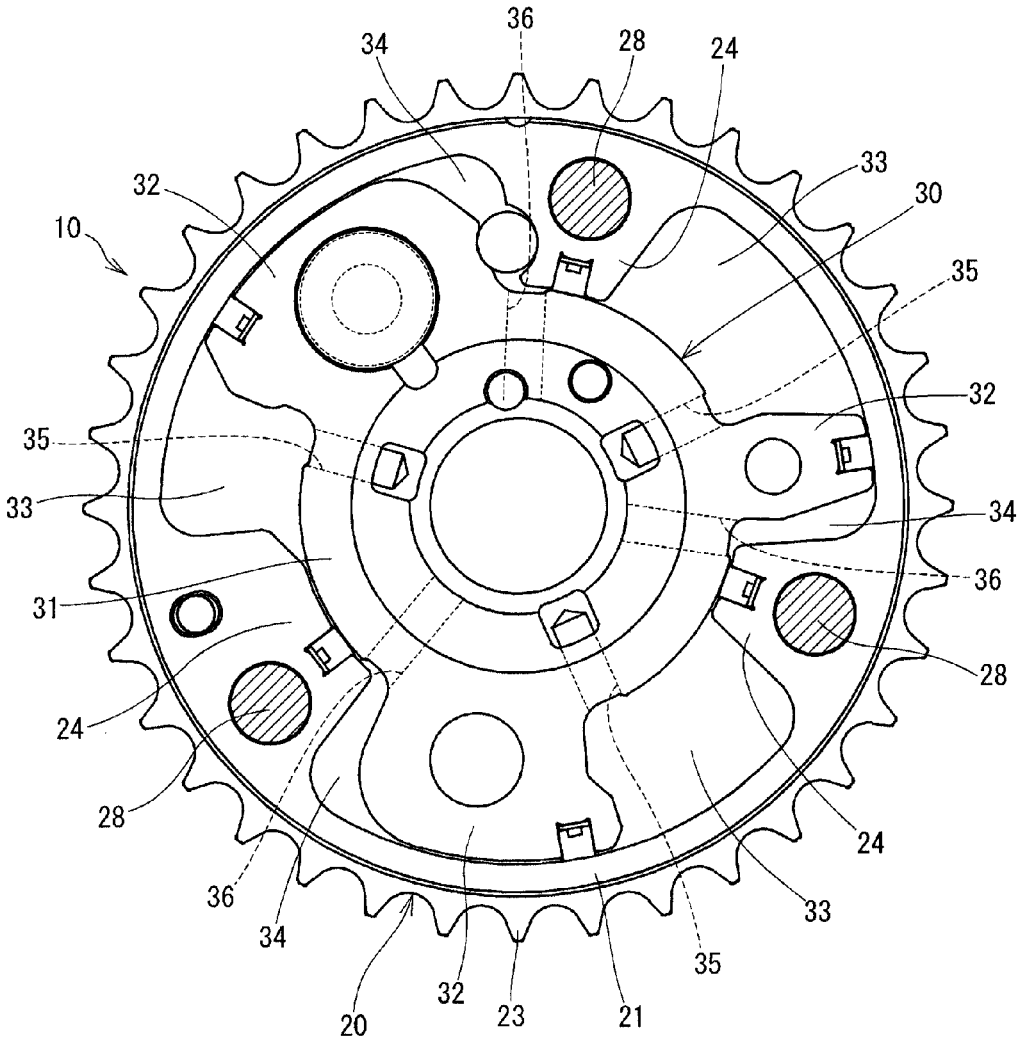
FIG. 2 is a cross-sectional view taken along line II-II in FIG. 1.

First of all, an entire structure of the valve timing control apparatus 10 will be described with reference to FIGS. 1 and 2. As shown in FIGS. 1 and 2, the valve timing control apparatus 10 includes a housing 20, a vane rotor 30, and an oil passage change valve 40.

The housing 20 includes a sprocket 21, a front plate 25, and a rear plate 26. The sprocket 21 is placed along an extension of an axis of the camshaft 92 and is coaxial with the camshaft 92. The sprocket 21 forms a tubular portion 22, an external gear tooth portion 23 and a plurality of projecting portions 24. The external gear tooth portion 23, which has external gear teeth arranged one after another in a circumferential direction, is formed in an outer wall of the tubular portion 22 and is connected to the crankshaft 91 through a timing chain 93. The projecting portions 24 radially inwardly project from the tubular portion 22.

The front plate 25 is placed on one axial side of the sprocket 21. The rear plate 26 is placed on the other axial side of the sprocket 21, which is opposite from the one axial side. A fitting hole 27 is formed in a center part of the rear plate 26. The camshaft 92 is fitted into the fitting hole 27 of the rear plate 26. The sprocket 21, the front plate 25 and the rear plate 26 are secured together with bolts 28. The housing 20 is rotatable together with the crankshaft 91.

The vane rotor 30 is received in the housing 20 and is rotatable relative to the housing 20. The vane rotor 30 forms a boss 31 and a plurality of vanes 32. The boss 31 is fixed to the camshaft 92 with a sleeve bolt 41 described later. The vanes 32 radially outwardly project from the boss 31. Each of the vanes 32 partitions an inside space of the housing 20, that is, each of the vanes 32 partitions a space, which is circumferentially defined between corresponding adjacent two of the projecting portions 24, into an advancing chamber 33 and a retarding chamber 34. The retarding chamber 34 is located on one side of the vane 32 in a rotational direction, and the advancing chamber 33 is located on the other side of the vane 32 in the rotational direction.

The vane rotor 30 includes advancing oil passages 35, retarding oil passages 36, and supply oil passages 37. One end of each advancing oil passage 35 is communicated with the corresponding advancing chamber 33, and the other end of the advancing oil passage 35 opens in an inner wall surface of the boss 31. One end of each retarding oil passage 36 is communicated with the corresponding retarding chamber 34, and the other end of the retarding oil passage 36 opens in the inner wall surface of the boss 31. One end of each supply oil passage 37 opens in an end surface of the boss 31, which is located on a side where camshaft 92 is placed, and the other end of the supply oil passage 37 opens in the inner wall surface of the boss 31. An external oil passage 94 of the camshaft 92 is communicated with an oil pump 96 through an oil passage 95 formed in, for example, an engine block. The supply oil passages 37 are connected to the external oil passage 94.

The vane rotor 30 is rotated relative to the housing 20 when a pressure force of the hydraulic oil supplied to the advancing chambers 33 or the retarding chambers 34 is applied to the vane rotor 30 to change the rotational phase of the vane rotor 30 relative to the housing 20 to an advancing side or a retarding side.

The oil passage change valve 40 includes the sleeve bolt 41 and a spool 48.

The sleeve bolt 41 is inserted into a center portion of the vane rotor 30 from a side that is opposite from the camshaft 92 such that the sleeve bolt 41 is threaded into the camshaft 92. Furthermore, the sleeve bolt 41 forms a sleeve portion 44 between a head 42 and a threaded portion 43. The sleeve portion 44 is placed in an inside of the vane rotor 30. Furthermore, the sleeve portion 44 includes advancing ports 45, which are communicated with the advancing oil passages 35, retarding ports 46, which are communicated with the retarding oil passages 36, and supply ports 47, which are communicated with the supply oil passages 37.

The spool 48 is reciprocatable in the axial direction in an inside of the sleeve portion 44 of the sleeve bolt 41. The spool 48 can selectively communicate between corresponding ones of the ports of the sleeve portion 44 depending on an axial position of the spool 48. Specifically, in a case where the rotational phase of the vane rotor 30 relative to the housing 20 is changed to the advancing side, the spool 48 connects the supply ports 47 to the advancing ports 45 and communicates the retarding ports 46 to an external drain space located at an outside through the inside of the spool 48. Furthermore, in a case where the rotational phase of the vane rotor 30 relative to the housing 20 is changed to the retarding side, the spool 48 connects the supply ports 47 to the retarding ports 46 and communicates the advancing ports 45 to the external drain space through the outside of the spool 48.

A stopper plate 49 is fitted to an opening of the sleeve bolt 41, which is located in an inside of the head 42 of the sleeve bolt 41. The spool 48 is urged against the stopper plate 49 by a spring 39. An axial position of the spool 48 is determined by a balance between an urging force of the spring 39 and an urging force of a linear solenoid 97, which is located on an opposite side of the stopper plate 49 that is opposite from the spool 48.

In the valve timing control apparatus 10, which is constructed in the above-described manner, in the case where the rotational phase is on a retarding side of a target value, the oil passage change valve 40 connects each advancing chamber 33 to the supply oil passages 37 and also connects each retarding chamber 34 to the external drain space. In this way, the hydraulic oil is supplied to the advancing chambers 33, and the hydraulic oil is drained from the retarding chambers 34. Thereby, the vane rotor 30 is rotated relative to the housing 20 toward the advancing side.

Furthermore, in the case where the rotational phase is on the advancing side of the target value, the oil passage change valve 40 connects each retarding chamber 34 to the supply oil passages 37 and also connects each advancing chamber 33 to the external drain space. In this way, the hydraulic oil is supplied to the retarding chambers 34, and the hydraulic oil is drained from the advancing chambers 33 to the outside. Thereby, the vane rotor 30 is rotated relative to the housing 20 toward the retarding side.

Furthermore, in a case where the rotational phase coincides with the target value, the oil passage change valve 40 closes the advancing chambers 33 and the retarding chambers 34. In this way, the current rotational phase is maintained.

Next, a characteristic structure of the valve timing control apparatus 10 will be described with reference to FIGS. 3 to 10.

Figure 3:
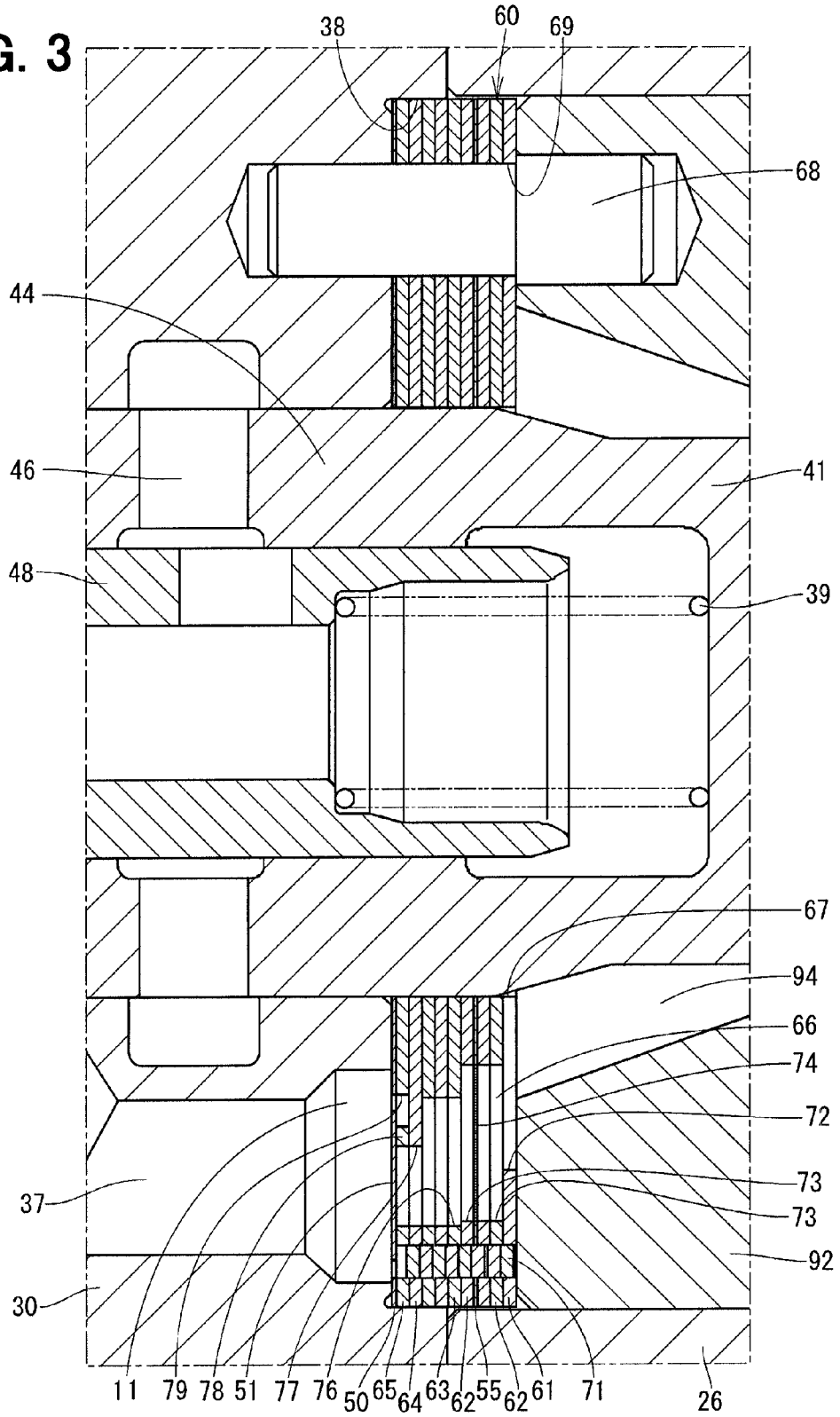
FIG. 3 is an enlarged cross sectional view showing an area III in FIG. 1.

As shown in FIG. 3, the valve timing control apparatus 10 further includes a check valve 50, a filter 55, and a filter holding body 60.

Figure 4:
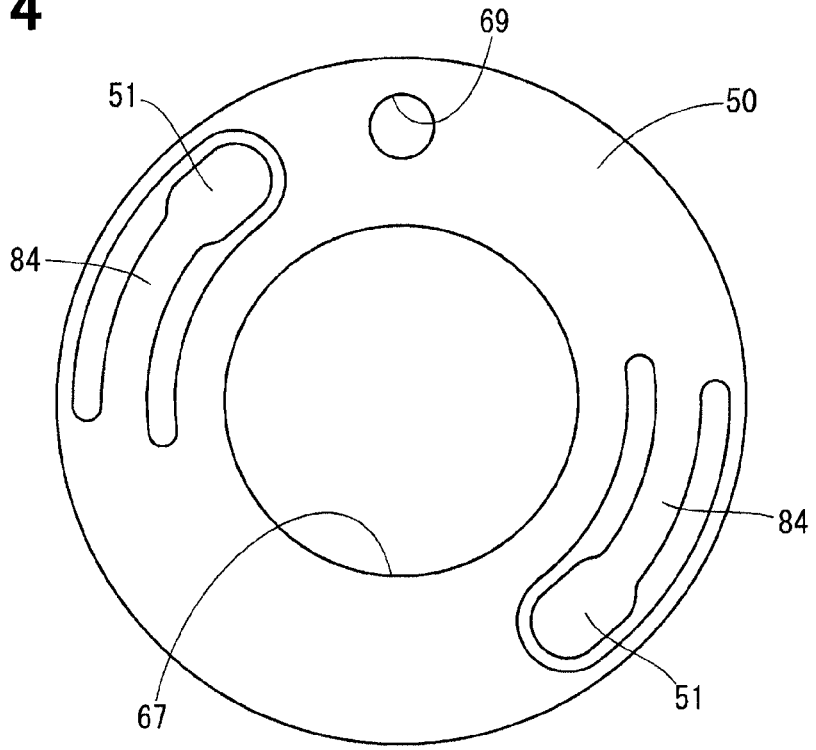
FIG. 4 is a view showing a check valve of FIG. 3.

The check valve 50 is placed between the camshaft 92 and the vane rotor 30 and is clamped between the vane rotor 30 and the filter holding body 60. In the present embodiment, as shown in FIG. 4, the check valve 50 is a reed valve that has two valve elements 51. The check valve 50 enables flow of hydraulic oil from the external oil passage 94 to the supply oil passages 37 and blocks flow of the hydraulic oil from the supply oil passages 37 to the external oil passage 94. In this way, back flow of the hydraulic oil from the supply oil passages 37 to the external oil passage 94 is limited. A valve element receiving space 11 is formed on the downstream side of the check valve 50 and is connected to the supply oil passage 37. The valve element receiving space 11 receives the valve elements 51 of the check valve 50 when the valve elements 51 are lifted from valve seats 78 of the metal plate 65 in a direction away from the camshaft 92.

As shown in FIG. 3, the filter 55 is placed between the camshaft 92 and the check valve 50 and can filter foreign objects (e.g., debris) contained in the hydraulic oil, which flows from the external oil passage 94 to the supply oil passages 37.

The filter holding body 60 is placed between the camshaft 92 and the check valve 50 and includes a connection oil passage 66 that connects the external oil passage 94 to the supply oil passages 37. In the present embodiment, the filter holding body 60 is press fitted into a press fitting hole 38 of the vane rotor 30. The supply oil passages 37 open in a bottom surface of the press fitting hole 38. The check valve 50 is clamped and secured between the bottom surface of the press fitting hole 38 and the filter holding body 60.

Furthermore, the filter holding body 60 is a laminated body that includes a plurality of metal plates 61-65, which are stacked one after another in the axial direction of the vane rotor 30 while the filter 55 is clamped between corresponding two of the metal plates 61-65. Specifically, the filter holding body 60 includes a metal plate 61, two metal plates 62, the filter 55, a metal plate 62, three metal plates 63, a metal plate 64, and a metal plate 65, which are stacked one after another in this order from the camshaft 92 side.

Hereinafter, unless it is necessary to distinguish the respective metal plates 61-65, each of these metal plates 61-65 may be simply referred to as "metal plate". Furthermore, a term "outer side" may refer to a radially outer side of the filter holding body 60 in a radial direction of the filter holding body 60, and a term "inner side" may refer to a radially inner side of the filter holding body 60 in the radial direction.

Figure 5:
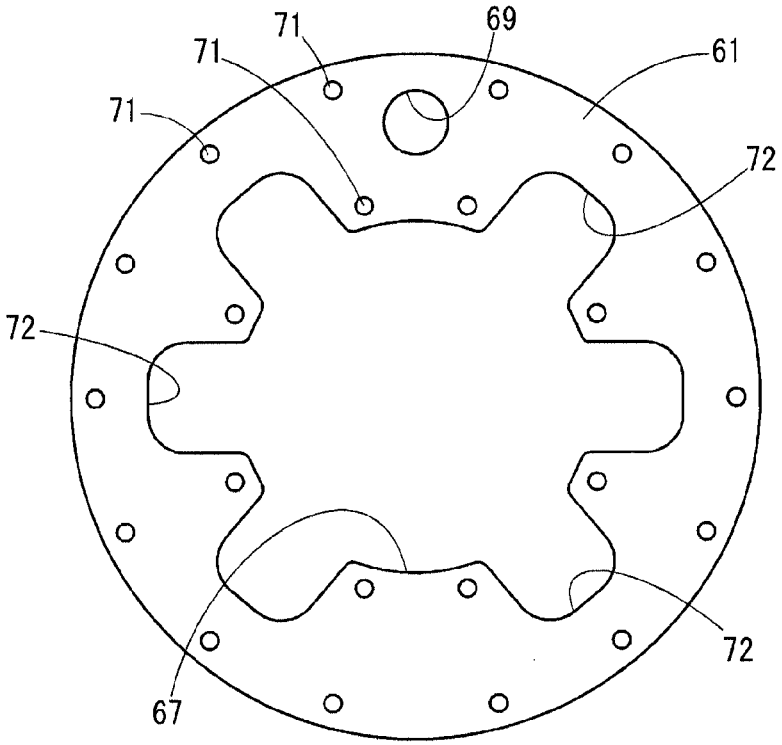
FIG. 5 is a view showing a first metal plate of a filter holding body of FIG. 3.

As shown in FIGS. 3 and 5, the metal plate 61 includes a sleeve hole 67, a knock pin hole 69, a plurality of dimples 71 (each dimple 71 forms a projection on one axial side of the metal plate 61 and a recess on the other axial side of the metal plate 61), and six notches (radial recesses) 72. The sleeve hole 67 of the metal plate 61 receives the sleeve portion 44 of the sleeve bolt 41 therethrough. The knock pin hole 69 of the metal plate 61 receives a knock pin 68 therethrough. The dimples 71 are also formed in each of the other metal plates 62-65, and the dimples 71 of the metal plates 61-65 are used to assemble the metal plates 61-65 together. The notches 72 are arranged one after another in a circumferential direction along an inner peripheral edge of the sleeve hole 67 and are radially outwardly recessed from the inner peripheral edge of the sleeve hole 67 in the metal plate 61. The knock pin 68 is a pin that is used to position the vane rotor 30 relative to the camshaft 92 in the rotational direction. Each dimple 71 forms the projection on the one side of the metal plate 61, at which the camshaft 92 is placed, and the recess (a hole) on the other side of the metal plate 61, at which the vane rotor 30 is placed. Each adjacent two of the metal plates 61-65 are integrated (joined) together by press-fitting the projection of each dimple 71 of one of the adjacent two of the metal plates 61-65 into the recess of the corresponding dimple 71 of the other one of the adjacent two of the metal plates 61-65. The notches 72 are communicated with the external oil passage 94 and form a part of the connection oil passage 66.

Figure 6:
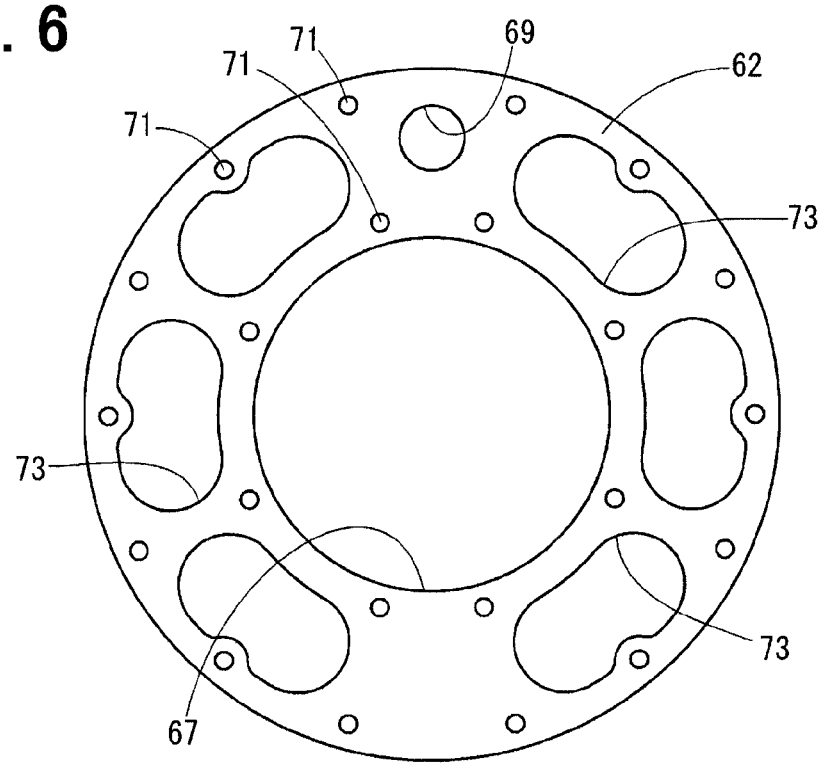
FIG. 6 is a view showing a second metal plate of the filter holding body of FIG. 3.

As shown in FIGS. 3 and 6, each metal plate 62 includes a sleeve hole 67, a knock pin hole 69 and six enlarged through holes 73. A flow passage cross-sectional area of each enlarged through hole 73 of each metal plate 62 is larger than a flow passage cross-sectional area of the external oil passage 94 and is also larger than a flow passage cross-sectional area of each supply oil passage 37, which has a circular cross section (see the passage cross-sectional area of the supply oil passage 37 at a location where a tip of a lead line associated with the numeral 37 is placed in FIG. 3). In the present embodiment, the number of the supply oil passages 37 is two, and these two supply oil passages 37 are communicated with two through holes 77, respectively, of the metal plate 65, which are opened and closed by the two valve elements 51, respectively, of the check valve 50. The flow passage cross-sectional area of each supply oil passage 37 is generally the same as a flow passage cross-sectional area of each of two through holes 77 of the metal plate 65 (and also a flow passage cross-sectional area of each of two through holes 77 of the metal plate 64). Each of the enlarged through holes 73 is formed at a corresponding location, at which the enlarged through hole 73 overlaps with the radially outer side portion of a corresponding one of the notches 72 in a view taken in the axial direction. Furthermore, the enlarged through holes 73 form a part of the connection oil passage 66. Each enlarged through hole 73 provides a locally enlarged space at a location adjacent to the filter 55 in order to increase a total opening cross-sectional area of the filter 55 in the connection oil passage 66 for the purpose of reducing or minimizing the pressure loss at the filter 55. Two of the three metal plates 62 (i.e., upstream side metal plates 62) are placed adjacent to the filter 55 on one side (an upstream side) of the filter 55 where the camshaft 92 is placed. Each of these two metal plates 62 serves as a first-side enlarged space forming plate (an upstream side enlarged space forming plate), and the enlarged through holes 73 of this metal plate 62 serve as first-side enlarged through holes (upstream side enlarged through holes). Furthermore, another one of the three metal plates 62 is placed adjacent to the filter 55 on the other side (a downstream side) of the filter 55 where the vane rotor 30 is placed. This one metal plate 62 serves as a second-side enlarged space forming plate (a single second-side enlarged space forming plate, a downstream side enlarged space forming plate), and the enlarged through holes 73 of this metal plate 62 serve as second-side enlarged through holes (downstream side enlarged through holes).

Figure 7:
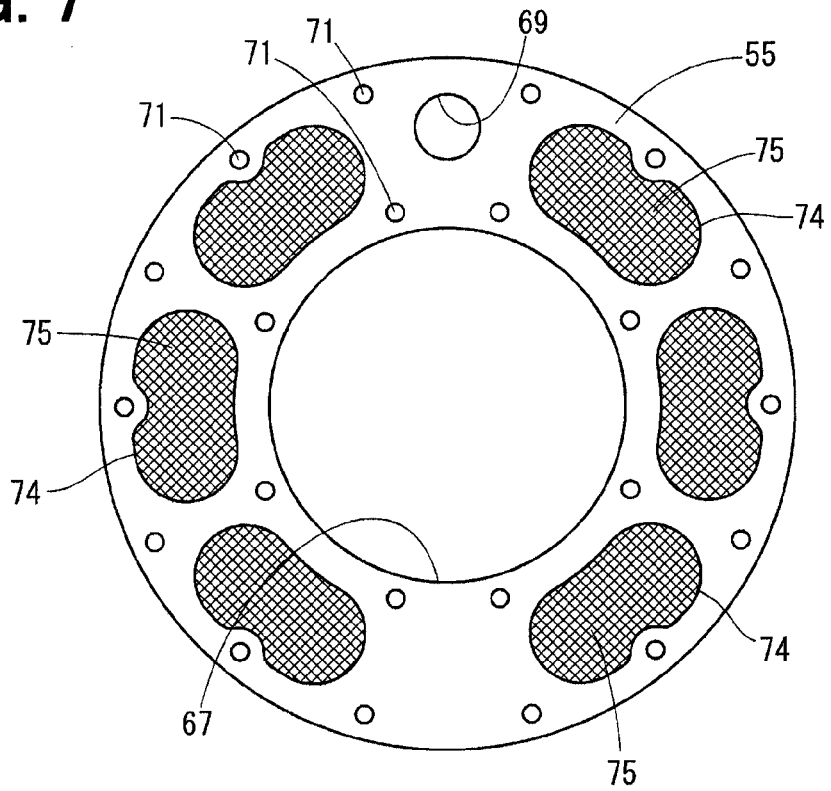
FIG. 7 is a view showing a filter of FIG. 3.

As shown in FIGS. 3 and 7, the filter 55 is a metal sheet (a metal plate) and includes a sleeve hole 67, a knock pin hole 69 and six filter portions 74. Each of the filter portions 74 is formed to overlap with the corresponding enlarged through hole 73 of each adjacent metal plate 62 (i.e., each of the metal plates 62 placed adjacent to the filter 55 on the camshaft 92 side and the metal plate 62 placed adjacent to the filter 55 on the vane rotor 30 side) in the view taken in the axial direction. Thereby, a size of each filter portion 74 measured in a plane perpendicular to the axial direction is generally the same as a size of each enlarged through-hole 73 measured in the plane perpendicular to the axial direction. Each filter portion 74 includes a plurality of minute holes (minute through holes) 75, which are communicated with the corresponding enlarged through hole 73 of each of the adjacent metal plates 62. The minute holes 75 are formed by, for example, a press working process, a laser process, or an etching process. An opening width of the minute hole 75 is set to, for example, 0.2 mm that is an upper limit value of a size of a foreign object that can be severed between the spool 48 of the oil passage change valve 40 and the sleeve portion 44. The filter 55 is placed adjacent to the check valve 50 on the upstream side of the check valve 50 and can capture small foreign objects that are smaller than foreign objects that can be captured by a cartridge filter provided to the internal combustion engine 90.

Figure 8:
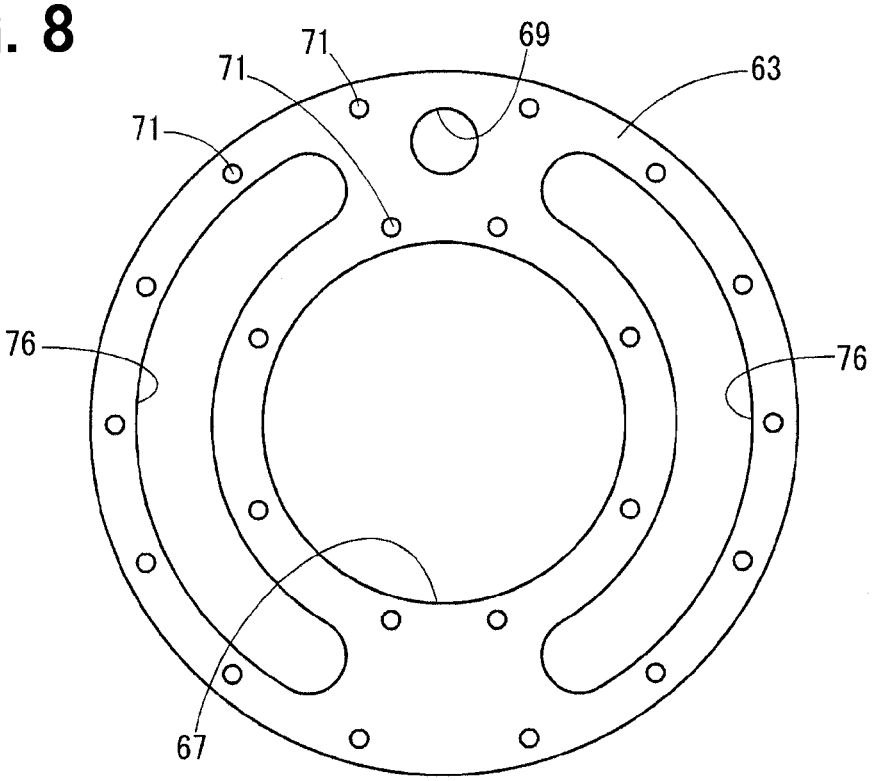
FIG. 8 is a view showing a third metal plate of the filter holding body of FIG. 3.

As shown in FIGS. 3 and 8, each metal plate 63 includes a sleeve hole 67, a knock pin hole 69, and two arcuate holes 76. Each of the arcuate holes 76 arcuately extends in a circumferential direction of the metal plate 63. The arcuate holes 76 form a part of the connection oil passage 66. Each of the arcuate holes 76 is formed at a corresponding location, at which the arcuate hole 76 overlaps with corresponding three of the enlarged through holes 73 of each metal plate 62 in the view taken in the axial direction.

Figure 9:
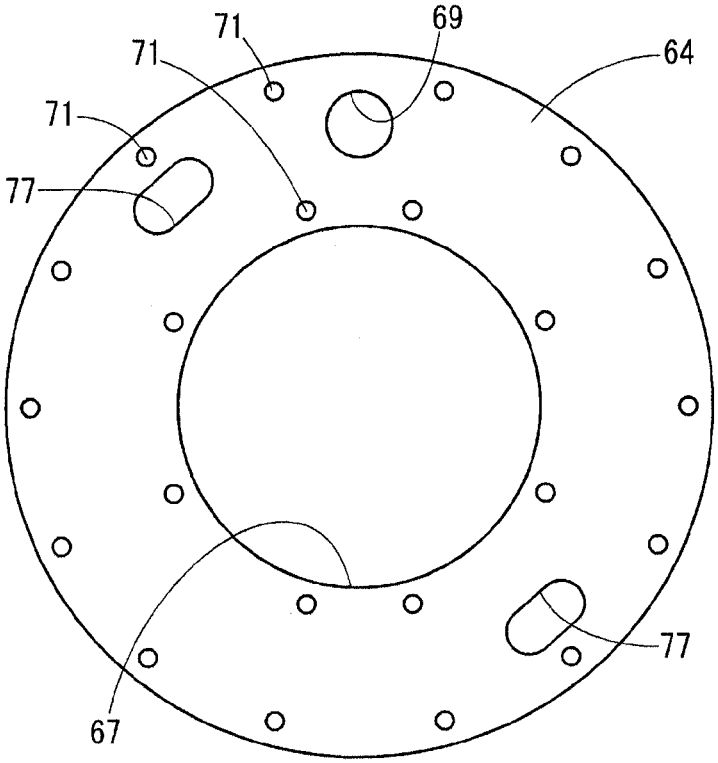
FIG. 9 is a view showing a fourth metal plate of the filter holding body of FIG. 3.

As shown in FIGS. 3 and 9, each metal plate 64 includes a sleeve hole 67, a knock pin hole 69 and two through holes 77. The through holes 77 form a part of the connection oil passage 66. Each of the through holes 77 is formed at a corresponding location, at which the through hole 77 overlaps with a corresponding one of the arcuate holes 76 of each metal plate 63 and a corresponding one of the supply oil passages 37 in the axial view.

Figure 10:
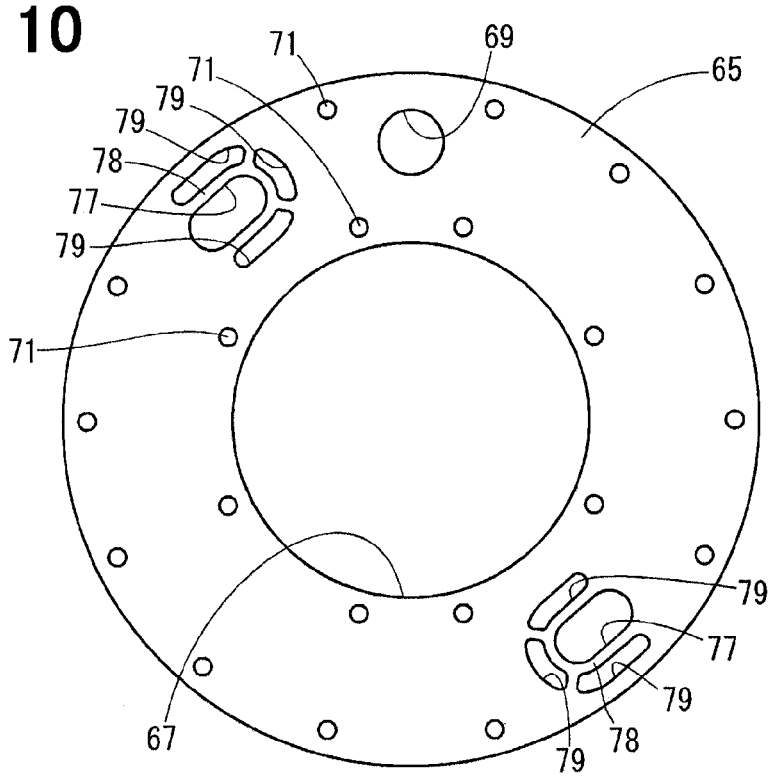
FIG. 10 is a view showing a fifth metal plate of the filter holding body of FIG. 3.
Figure 11:
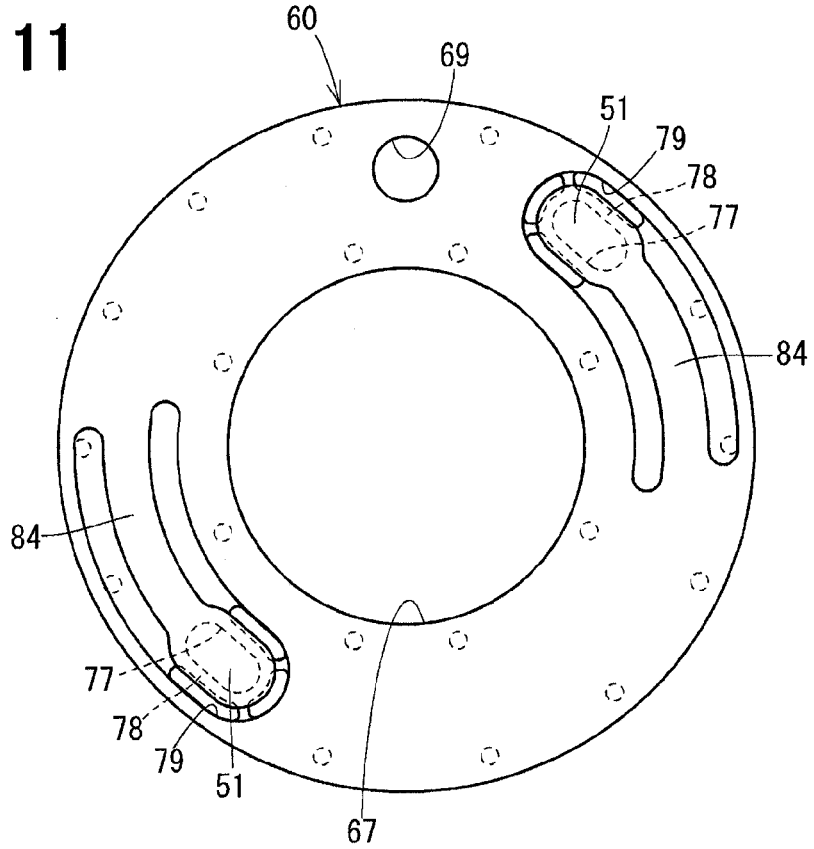
FIG. 11 is a view showing the check valve and the filter holding body of FIG. 3 taken from a vane rotor side.

As shown in FIGS. 3 and 10, the metal plate 65 includes a sleeve hole 67, a knock pin hole 69 and two through holes 77. The metal plate 65 is placed adjacent to the check valve 50 on the camshaft 92 side of the check valve 50. The metal plate 65 forms two valve seats 78. The valve elements 51 of the check valve 50 are seatable against the valve seats 78, respectively, of the metal plate 65. Furthermore, the metal plate 65 includes a plurality (six in this instance) of relief holes (escape holes) 79. In this instance, corresponding three of the relief holes 79 open around a corresponding one of the valve seats 78 to avoid or limit contact of an outer peripheral edge portion of the valve element 51 with the metal plate 65 when the valve element 51 is seated against the valve seat 78. The metal plate 65 serves as a valve seat forming plate of the present disclosure. FIG. 11 is a view of the check valve 50 and the filter holding body 60 taken from the vane rotor 30 side.

Figure 12:
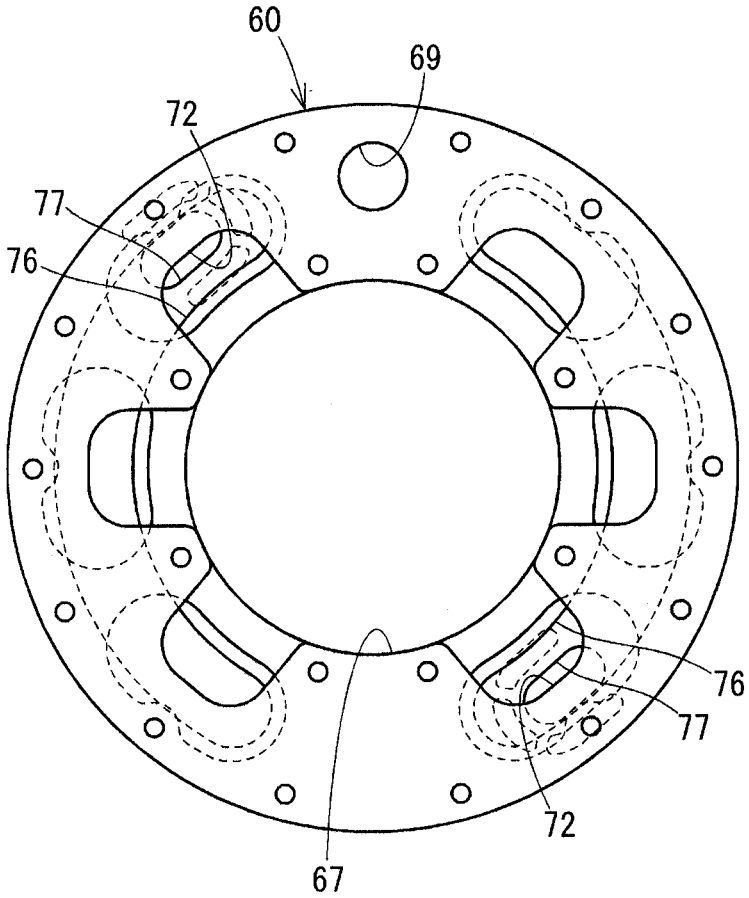
FIG. 12 is a view showing the filter holding body and the filter of FIG. 3 taken from a camshaft side.

In the present embodiment, a thickness (a plate thickness) of each of the metal plates 61-65 is 0.4 mm, and a thickness (a plate thickness) of the filter 55 is 0.1 mm. An axial length of the filter holding body 60 including the filter 55 is 3.7 mm. The metal plates 61-65 and the filter 55 are stacked in the predetermined order discussed above and are press fitted into the press fitting hole 38 of the vane rotor 30. Rotational movement and axial movement of the metal plates 61-65 and the filter 55, which are press fitted into the press fitting hole 38 of the vane rotor 30, are limited by the knock pin 68, which is configured into a stepped form. FIG. 12 is a view of the filter holding body 60 and the filter 55 taken from the camshaft 92 side.

Now, advantages of the present embodiment will be described.

As discussed above, in the first embodiment, the valve timing control apparatus 10 includes the check valve 50, the filter 55, and the filter holding body 60. The check valve 50 is placed between the camshaft 92 and the vane rotor 30. The check valve 50 enables the flow of the hydraulic oil from the external oil passage 94 to the supply oil passages 37 and blocks the flow of the hydraulic oil from the supply oil passages 37 to the external oil passage 94. The filter 55 is placed between the camshaft 92 and the check valve 50.

The filter holding body 60 is the laminated body that is placed between the camshaft 92 and the check valve 50 and includes the metal plates 61-65 stacked in the axial direction of the vane rotor 30 while the filter 55 is clamped between the corresponding two of the metal plates 61-65, and the filter holding body 60 includes the connection oil passage 66, which connects between the external oil passage 94 and the supply oil passages 37. The three metal plates 62 serve as the enlarged space forming plates and form the corresponding part of the filter holding body 60. The two of the metal plates 62 are placed at the corresponding location, which is adjacent to the filter 55 on the one side of the filter 55 where the camshaft 92 is placed, and the remaining one of the metal plates 62 is placed at the corresponding location, which is adjacent to the filter 55 on the other side of the filter 55 where the vane rotor 30 is placed. Each of the metal plates 62 includes the enlarged through holes 73, which form the part of the connection oil passage 66 at the corresponding location that is adjacent to the filter 55. Furthermore, the flow passage cross-sectional area of each of the enlarged through holes 73 of each metal plate 62 is larger than the flow passage cross-sectional area of each supply oil passage 37 and is also larger than the flow passage cross-sectional area of the external oil passage 94.

With the above-described construction, the two metal plates 62, the filter 55 and the one metal plate 62 are sequentially placed one after another in the axial direction at the location between the external oil passage 94 and the supply oil passages 37. The enlarged through holes 73 of the two metal plates 62, which are placed on the upstream side of the filter 55, and the enlarged through holes 73 of the remaining one metal plate 62, which is placed on the downstream side of the filter 55, form the locally enlarged spaces (enlarged spaces) in the middle of the connection oil passage 66 to increase the total opening cross-sectional area of the filter 55 in the connection oil passage 66 for the purpose of reducing or minimizing the pressure loss at the filter 55. In order to increase the total opening cross-sectional area of the filter 55, the size of each of the enlarged through holes 73 may be increased. Therefore, even when the thickness of each metal plate 62 is small, the flow of the hydraulic oil is not interfered. Furthermore, the filter 55 is made of the sheet having the minute holes 75.

Therefore, the axial size of the valve timing control apparatus 10 can be reduced by shortening the axial distance between the camshaft 92 and the vane rotor 30. In this way, the installability of the valve timing control apparatus 10 on the internal combustion engine 90 can be improved.

Furthermore, in the first embodiment, the filter 55 is formed by the metal sheet.

Therefore, the filter 55 is made as one type of the plates of the laminated body that is formed along with the metal plates 61-65, and thereby the axial distance between the camshaft 92 and the vane rotor 30 can be reduced. Furthermore, the metal plates 61-65 and the filter 55 can be integrated together by the dimples 71, which are formed in the metal plates 61-65 and the filter 55 by, for example, a press working process.

Furthermore, in the first embodiment, the metal plates (identical metal plates, i.e., the common metal plates) 62 of the same type are used as the metal plates which form the enlarged spaces on the front side (the upstream side) and the rear side (the downstream side) of the filter 55 in the axial direction. The two metal plates 62 are placed on the one side of the filter 55 where the camshaft 92 is placed, and the one metal plate 62 is placed on the other side of the filter 55 where the vane rotor 30 is placed.

Therefore, the manufacturing costs can be reduced by the use of the common parts, and it is easy to make a difference between the axial size of the enlarged space on the upstream side of the filter 55 and the axial size of the enlarged space on the downstream side of the filter 55. The axial size of the enlarged space on the downstream side of the filter 55 is minimized to such an extent that the enlarged space does not interfere with the flow of the hydraulic oil. In contrast, in order to limit clogging of the filter 55 with the captured foreign objects, which are captured with the filter 55, the axial size of the enlarged space on the upstream side of the filter 55 is set to a sufficiently large size that is sufficient to receive the captured foreign objects therein.

Furthermore, in the first embodiment, the check valve 50 is the reed valve that has the valve elements 51, each of which is configured into a sheet form (plate form) and opens and closes the connection oil passage 66. The check valve 50 is clamped and secured between the filter holding body 60 and the vane rotor 30.

Therefore, the filter holding body 60 can have a function of a bushing that is required in a previously proposed apparatus in order to hold the check valve 50. Thus, in the present embodiment, a dedicated bushing is no longer required. Thereby, the number of the components can be reduced, and the assembling can be eased.

Furthermore, in the first embodiment, the metal plate 65, which serves as the valve seat forming plate and forms the part of the filter holding body 60, is adjacent to the check valve 50 on the one side of the check valve 50 where the camshaft 92 is placed. The metal plate 65 forms the valve seats 78, against which the valve elements 51 are seatable. The corresponding relief holes 79 open around each valve seat 78 to avoid or limit contact of the outer peripheral edge portion of the valve element 51 with the metal plate 65 when the valve element 51 is seated against the valve seat 78.

Therefore, it is possible to limit chipping (damaging) of the outer peripheral edge portion of each valve element 51 at the valve closing time of the check valve 50 (i.e., the time of seating the valve element 51 of the check valve 50 against the valve seat 78).

Second Embodiment

A valve timing control apparatus according to a second embodiment of the present disclosure will be described with reference to FIGS. 13 to 16.

Figure 13:
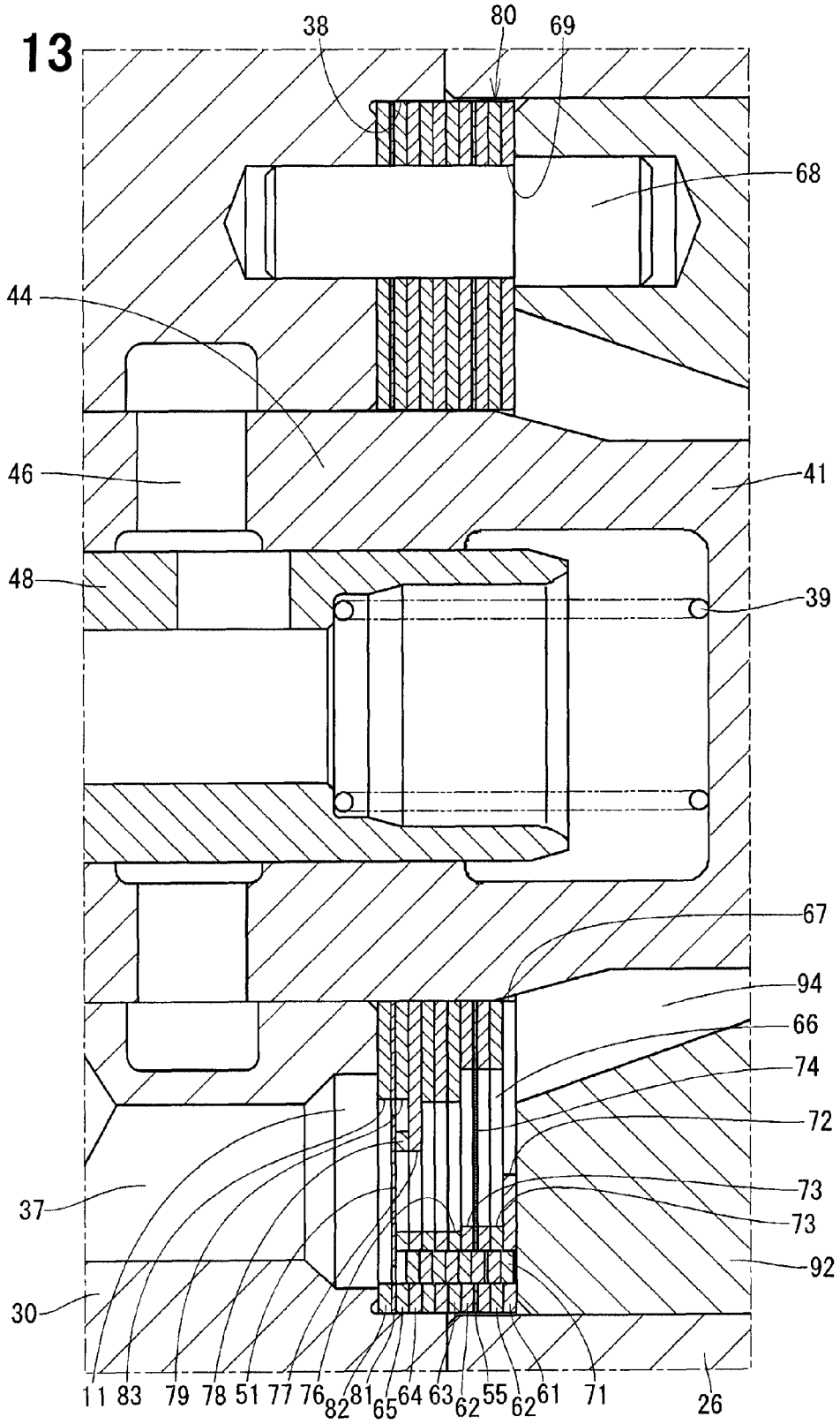
FIG. 13 is an enlarged cross-sectional view showing a filter holding body and a check valve of a valve timing control apparatus according to a second embodiment of the present disclosure.

As shown in FIG. 13, a filter holding body 80 is a laminated body that includes a plurality of metal plates 61-65, 82, which are stacked one after another in the axial direction of the vane rotor 30 while each of the filter 55 and the check valve 81 is clamped between corresponding two of the metal plates 61-65, 82. Specifically, the filter holding body 80 includes a metal plate 61, two metal plates 62, a filter 55, a metal plate 62, three metal plates 63, a metal plate 64, a metal plate 65, a check valve 81, and a metal plate 82, which are stacked one after another in this order from the camshaft 92 side (upstream side).

Figure 14:
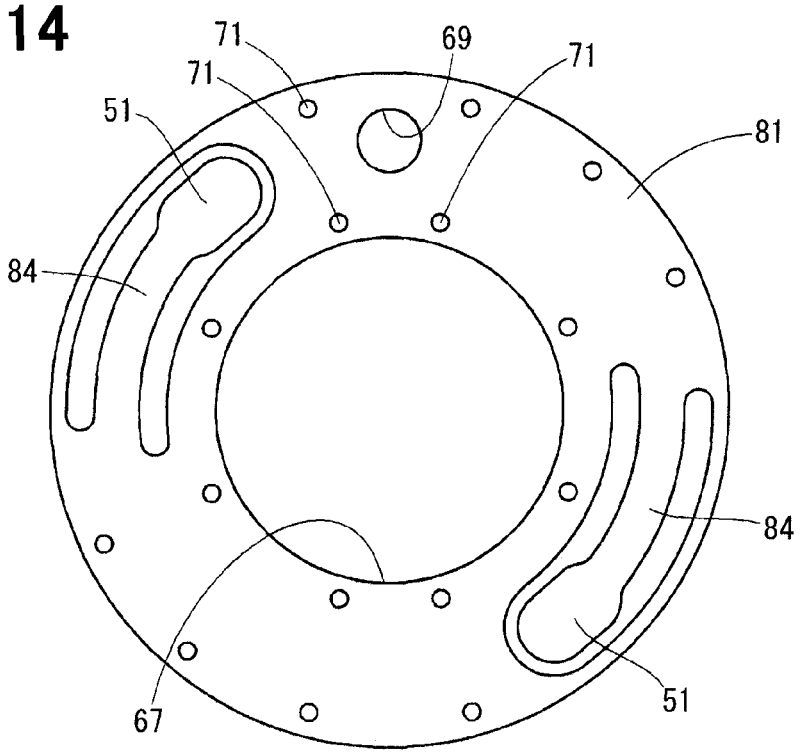
FIG. 14 is a view showing a check valve of FIG. 13.

As shown in FIG. 14, the check valve 81 is the same as the check valve 50 of the first embodiment except that the check valve 81 includes dimples 71 (each dimple 71 forming a projection on one axial side of the check valve 81 and a recess on the other axial side of the check valve 81).

Figure 15:
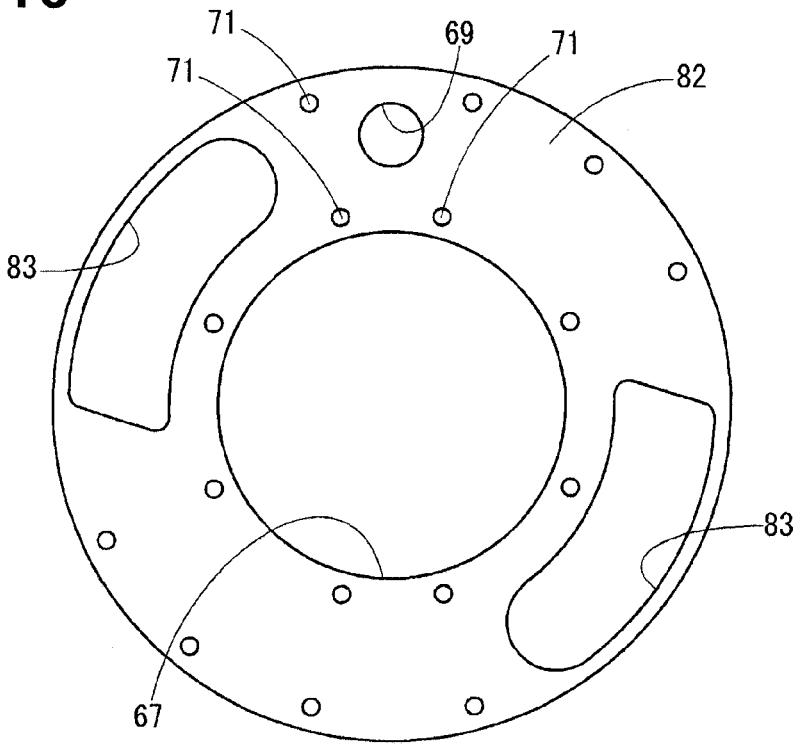
FIG. 15 is a view showing a sixth metal plate of the filter holding body of FIG. 13.
Figure 16:
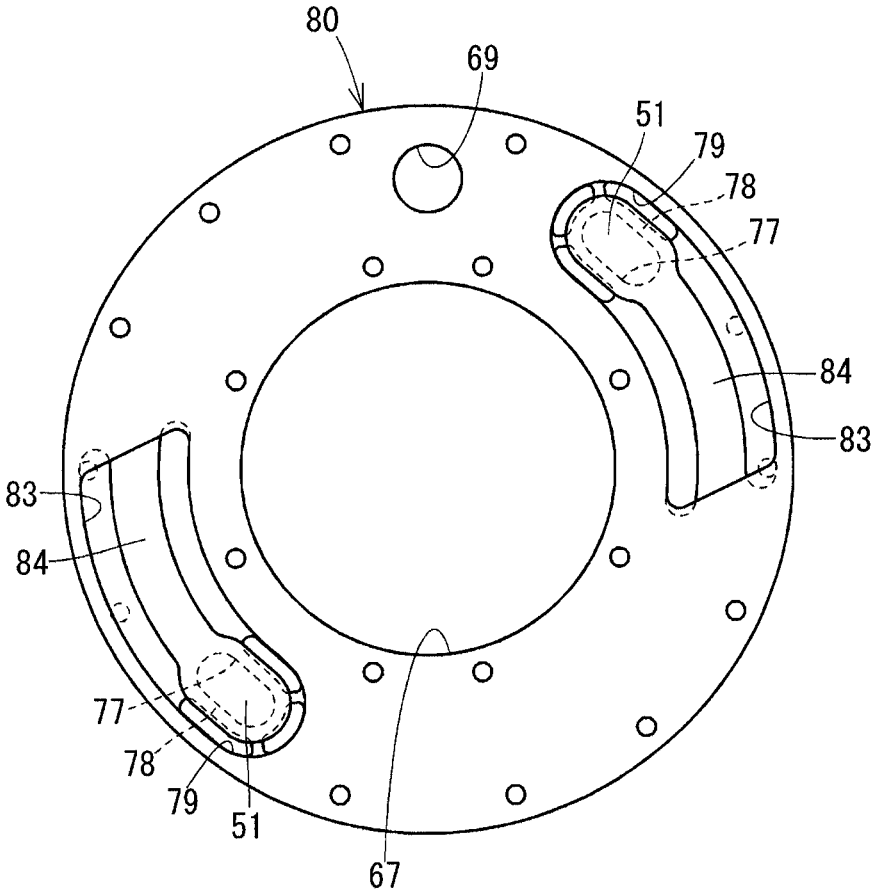
FIG. 16 is a view showing the filter holding body and the check valve of FIG. 13 taken from a vane rotor side.

As shown in FIGS. 15 and 16, the metal plate 82 includes a sleeve hole 67, a knock pin hole 69, and two arcuate holes 83. Each of the arcuate holes 83 arcuately extends in a circumferential direction of the metal plate 82. The arcuate holes 83 form a part of the connection oil passage 66. Each of the arcuate holes 83 is formed at a corresponding location, at which the arcuate hole 83 overlaps with a corresponding one of valve elements 51 of the check valve 81 and a corresponding one of arms 84 of the check valve 81 in the view taken in the axial direction. Each arcuate hole 83 functions as a relief hole (escape hole) that relieves or receives the corresponding valve element 51 and the corresponding arm 84 at the valve opening time of the check valve 81 (i.e., at the time of lifting the valve element 51 of the check valve 81 away from the valve seat 78 of the metal plate 65).

As discussed above, according to the second embodiment, the advantages, which are similar to the advantages of the first embodiment, can be achieved. Furthermore, since the check valve 81 is clamped and secured between the corresponding two of the metal plates of the filter holding body 80, the assembling can be eased.

Other Embodiments

In another embodiment of the present disclosure, an opening width of each minute hole 75 of each filter portion 74 of the filter 55 may be set to a value that is other than 0.2 mm, i.e., a value that is smaller than 0.2 mm or larger than 0.2 mm.

In another embodiment of the present disclosure, the respective metal plates of the filter holding body may be integrally assembled together by, for example, swaging (cold forging) or welding.

In another embodiment of the present disclosure, the filter may be formed by a plurality of metal sheets instead of the single metal plate.

In another embodiment of the present disclosure, the configuration of the metal plate(s), which is placed adjacent to the filter on the upstream side of the filter, may be different from the configuration of the metal plate, which is placed adjacent to the filter on the downstream side of the filter.

In another embodiment of the present disclosure, the valve timing control apparatus may be a valve timing control apparatus, which adjusts valve timing of exhaust valves of the internal combustion engine.

In another embodiment of the present disclosure, the number of the supply oil passages 37 may be changed from the two to one or larger than two. Also, the number of the through holes 77 of the metal plate 65 (and thereby the number of the through holes 77 of the metal plate 64 and the number of the valve elements 51 of the check valve 50, 81) may be changed from the two to one or larger than two.

The present disclosure is not limited the above embodiments. That is, the above embodiments may be further modified in various ways without departing from the principle of the present disclosure.

What is claimed is:

1. A valve timing control apparatus that is placed in a drive force transmission path, which transmits a drive force from a drive shaft of an internal combustion engine to a driven shaft, to adjust valve timing of a valve that is opened and closed by the driven shaft, wherein one of the drive shaft and the driven shaft serves as a first shaft while another one of the drive shaft and the driven shaft serves as a second shaft, and an oil passage, which opens in an end surface of the second shaft, serves as an external oil passage, the valve timing control apparatus comprising:

a housing that is rotatable together with the first shaft;

a vane rotor that is placed along an extension of an axis of the second shaft and is rotatable together with the second shaft, wherein the vane rotor forms a vane, which partitions an inside space of the housing into an advancing chamber and a retarding chamber, and the vane rotor includes:

an advancing oil passage, which is communicated with the advancing chamber;

a retarding oil passage, which is communicated with the retarding chamber; and a supply oil passage, which opens on a side where the second shaft is placed, wherein the supply oil passage is communicatable with the external oil passage;

an oil passage change valve that is placed in a center portion of the vane rotor and includes:

an advancing port, which is communicated with the advancing oil passage;

a retarding port, which is communicated with the retarding oil passage; and a supply port, which is communicated with the supply oil passage, wherein the oil passage change valve connects between the supply port and the advancing port at a time of rotating the vane rotor toward an advancing side relative to the housing and connects between the supply port and the retarding port at a time of rotating the vane rotor toward a retarding side relative to the housing;

a check valve that is provided between the second shaft and the vane rotor or is provided in an inside of the vane rotor, wherein the check valve enables flow of hydraulic oil from the external oil passage to the supply oil passage and blocks flow of the hydraulic oil from the supply oil passage to the external oil passage;

a filter that is placed between the second shaft and the check valve and filters a foreign object contained in the hydraulic oil that flows from the external oil passage to the supply oil passage; and a filter holding body that is a laminated body, which is placed between the second shaft and the vane rotor and includes a plurality of metal plates that are stacked one after another in an axial direction of the vane rotor while the filter is clamped between corresponding two of the plurality of metal plates, wherein the filter holding body includes a connection oil passage that connects between the external oil passage and the supply oil passage, wherein:

the plurality of metal plates includes:

a first-side enlarged space forming plate that is placed adjacent to the filter on one side of the filter where the second shaft is placed, wherein the first-side enlarged space forming plate includes a first-side enlarged through hole, which forms a part of the connection oil passage, and a flow passage cross-sectional area of the first-side enlarged through hole is larger than a flow passage cross-sectional area of the supply oil passage; and a second-side enlarged space forming plate that is placed adjacent to the filter on another side of the filter where the vane rotor is placed, wherein the second-side enlarged space forming plate includes a second-side enlarged through hole, which forms a part of the connection oil passage, and a flow passage cross-sectional area of the second-side enlarged through hole is larger than the flow passage cross-sectional area of the supply oil passage.

2. The valve timing control apparatus according to claim 1, wherein the filter is a sheet, which is made of metal and includes a plurality of minute holes that are communicated with the first-side enlarged through hole and the second-side enlarged through hole.

3. The valve timing control apparatus according to claim 1, wherein:

a configuration of the first-side enlarged space forming plate and a configuration of the second-side enlarged space forming plate are identical to each other;

the first-side enlarged space forming plate is one of a plurality of first-side enlarged space forming plates placed on the one side of the filter where the second shaft is placed; and the second-side enlarged space forming plate is a single second-side enlarged space forming plate placed on the another side of the filter where the vane rotor is placed.

4. The valve timing control apparatus according to claim 1, wherein:

the check valve is a reed valve that includes a valve element, which opens and closes the connection oil passage; and the check valve is held and secured between the filter holding body and the vane rotor or is held and secured between two of the plurality of metal plates of the filter holding body.

5. The valve timing control apparatus according to claim 4, wherein:

the plurality of metal plates includes a valve seat forming plate that is placed adjacent to the check valve on a side of the check valve where second shaft is placed;

the valve seat forming plate forms a valve seat, against which the valve element is seatable; and the valve seat forming plate includes at least one relief hole that opens around the valve seat to limit contact of an outer peripheral edge portion of the valve element with the valve seat forming plate when the valve element is seated against the valve seat.

* * * * *